US008267012B2

(12) United States Patent
Peeters et al.

(10) Patent No.: US 8,267,012 B2
(45) Date of Patent: Sep. 18, 2012

(54) RELIABLE PROPAGATION OF IGNITION IN PERFORATION SYSTEMS

(75) Inventors: Roland Peeters, Laatzen (DE); Malte Veehmayer, Siegburg (DE); Oliver Axel Eichten, Lohmar (DE)

(73) Assignee: Dynaenergetics GmbH & Co. KG, Troisdorf (DE)

( * ) Notice: Subject to any disclaimer, the term of this patent is extended or adjusted under 35 U.S.C. 154(b) by 826 days.

(21) Appl. No.: 11/721,391

(22) PCT Filed: Dec. 6, 2005

(86) PCT No.: PCT/EP2005/013040

§ 371 (c)(1),
(2), (4) Date: Sep. 17, 2009

(87) PCT Pub. No.: WO2006/063713

PCT Pub. Date: Jun. 22, 2006

(65) Prior Publication Data

US 2010/0024674 A1 Feb. 4, 2010

(30) Foreign Application Priority Data

Dec. 13, 2004 (DE) ..... 10 2004 060 137

(51) Int. Cl.
*F42D 1/04* (2006.01)
*C06C 5/06* (2006.01)
*C06C 5/04* (2006.01)

(52) U.S. Cl. ..... 102/275.4; 102/275.7; 102/275.8

(58) Field of Classification Search ..... 102/275.1, 102/275.4, 275.7, 275.8
See application file for complete search history.

(56) References Cited

U.S. PATENT DOCUMENTS

| | | | | |
|---|---|---|---|---|
| 927,968 | A | 7/1909 | Harle | |
| 3,129,663 | A * | 4/1964 | Schnepfe, Jr | 102/275.4 |
| 3,700,269 | A | 10/1972 | Salata | |
| 3,707,917 | A * | 1/1973 | Zernow et al. | 102/275.9 |
| 4,616,566 | A * | 10/1986 | Yates, Jr. | 102/318 |
| 4,836,109 | A * | 6/1989 | Wesson et al. | 102/312 |
| 5,155,293 | A * | 10/1992 | Barton | 102/312 |
| 5,327,835 | A * | 7/1994 | Adams et al. | 102/275.11 |
| 5,417,162 | A | 5/1995 | Adams et al. | |
| 6,435,095 | B1 * | 8/2002 | Menzel et al. | 102/275.7 |
| 2002/0139274 | A1 | 10/2002 | Yang et al. | |
| 2004/0216632 | A1 | 11/2004 | Finsterwald | |

FOREIGN PATENT DOCUMENTS

| | | |
|---|---|---|
| AU | 1694970 | 8/1973 |

* cited by examiner

*Primary Examiner* — James Bergin
(74) *Attorney, Agent, or Firm* — Antonelli, Terry, Stout & Kraus, LLP.

(57) ABSTRACT

The invention relates to a method and a device for propagating the detonation effect from one detonation cord (5) to another, whereby the detonation cords (5) comprise respective boosters (4) at their ends. The booster of one detonation cord and the booster of the other detonation cord to which the detonation effect should be propagated are arranged with their front faces joining each other. The aim of the invention is to provide a method and a device which allows propagation also under unfavorable conditions while requiring only few individual parts. For this purpose, at least one booster of two adjacent detonation cords is subjected to a force acting in the direction of the other booster, thereby ensuring constant contact of the front faces (15) of the adjacent boosters.

19 Claims, 5 Drawing Sheets

Fig.7
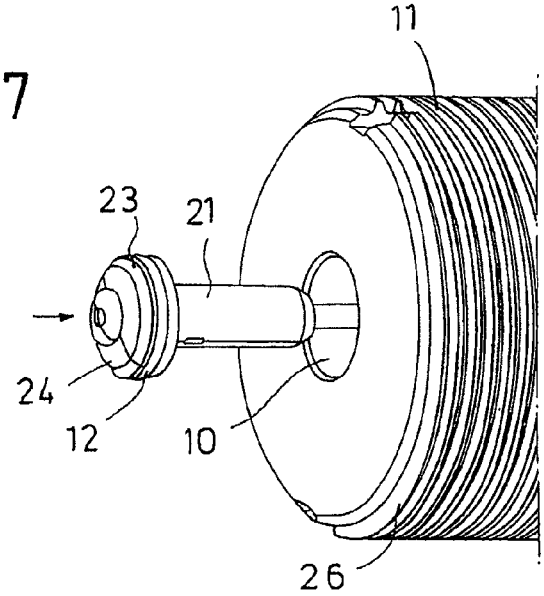
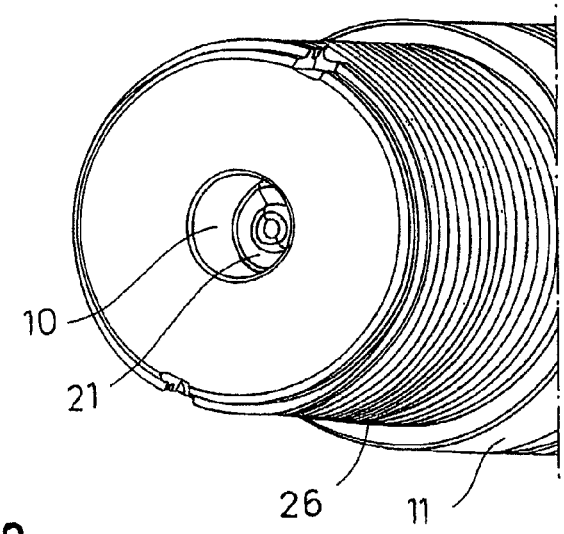
Fig.8

RELIABLE PROPAGATION OF IGNITION IN PERFORATION SYSTEMS

The invention relates to a method for transmitting the detonation effect from one detonating cord to another, the detonating cords having a booster at their respective ends and the booster of the one detonating cord together with the booster of the other detonating cord, to which the detonation effect is to be transmitted, being arranged with their front sides adjacent, and to a device having individual segments coupled to one another, each segment containing charges of explosive, and having detonating cords led through each segment and serving to ignite the charges, the detonating cords having boosters at their respective ends, and the first booster of the detonating cord of the first segment being coupled to the adjoining second booster of the detonating cord of the second segment in such way that the boosters lie opposite in their axial direction and thus, on use, transmit the ignition process from the first segment to the second segment, the boosters each being fixed in a receiving device.

Perforation systems, as an example in which reliable transmission of the detonation effect is extremely important, are used, for example, in deep borehole blasting in the petroleum and natural gas industry for connecting the borehole to the storage horizon.

Depending on the requirements, a perforation system comprises a plurality of individual segments having perforators, each segment comprising a carrier tube having an internal holding device for receiving the perforators. Often the individual segments are connected only on site to one another, in the axial direction via connecting parts.

The perforators are ignited by detonating cords. Since the individual segments are connected only on site, it is known to connect the detonating cords in such a way that the ignition is transmitted from one segment to another. For this purpose, the detonating cords are provided with boosters at their ends, the first booster of the detonating cord of the first segment being coupled to the adjoining second booster of the detonating cord of the second element in such a way that the two boosters lie opposite in their axial direction, i.e. are arranged on a straight line opposite one another. By means of this arrangement, the ignition process is transmitted from one detonating cord via the booster to the adjacent booster and then to the adjacent detonating cord.

Boosters are understood here to mean generally a donor or acceptor booster. The donor booster of the one detonating cord is coupled to the acceptor booster of the other detonating cord or vice versa. However, booster is also understood to mean a bidirectional booster. For simplification, only boosters generally are therefore referred to in this description, without making the distinction between donor booster and acceptor booster or bidirectional booster.

On preparation for use, the above-mentioned connecting part is screwed by one of its threads into one segment. Next, the detonating cord, provided with a booster, is introduced into the connecting part and the segment in such a way that the booster is situated in the region of that end of the connecting part facing the adjacent segment.

It is known to fix the boosters in each case in a receiving device and to anchor the receiving device firmly in the segment.

The disadvantage here is that the distance between the front sides of two adjacent boosters can vary owing to temperature influences, with the result that reliable transmission of the ignition is often not ensured. The length of the detonating cord must be precisely matched to the measured length. Moreover, between the front sides foreign bodies may accumulate which may interfere with the transfer of the ignition and also ensure that the adjacent booster is not initiated.

Furthermore, these transfer kits require many individual parts and are therefore expensive and labour-intensive. Owing to varying outside diameters of the charge carrier tube, different transfer kits are required.

The object on which the invention is based is to improve a method for transmission of the detonation effect from one detonating cord to another in such a way that the transmission is ensured even in difficult conditions and few individual parts are required.

This object is achieved according to the invention by at least one booster of two adjacent detonating cords to a force in the direction of the other booster, so that the front sides of the adjacent boosters are always in contact. Owing to the fact that at least one booster of two adjacent detonating cords is subjected to a force in the direction of the other booster, so that the front sides of the adjacent boosters are always in contact, the transmission is ensured with simple means even in difficult installation conditions.

In a refinement according to the invention, the boosters are arranged in receiving devices and at least one of the receiving devices of two adjacent detonating cords is subjected to a force in the direction of the adjacent receiving device.

Devices having individual segments coupled to one another are known, each segment containing charges of explosive, and having detonating cords led through each segment and serving to ignite the charges, the detonating cords having boosters at their respective ends, and the first booster of the detonating cord of the first segment being coupled to the adjoining second booster of the detonating cord of the second segment in such way that the boosters lie opposite in their axial direction and thus, on use, transmit the ignition process from the first segment to the second segment, the boosters each being fixed in a receiving device.

According to the invention, in the case of these devices, at least one of the receiving devices is subjected to a force in the direction of the adjacent receiving device, so that the front sides of the adjacent boosters are always in contact on use of the device.

Owing to the fact that at least one of the receiving devices is subjected to a force in the direction of the adjacent receiving device, so that the front sides of the adjacent boosters are always in contact on use of the device, reliable transmission of the ignition from one segment to another is ensured and only few individual parts are required.

Preferably, the receiving device not subjected to a force is fixed in the segment.

An expedient development of the invention is distinguished in that the segments are connected to one another via a connecting part on use and one of the adjacent receiving devices is fixed in the connecting part.

Advantageously, the device is a perforating gun for deep borehole blasting and the charges are perforators.

In a preferred embodiment, the force to which the other receiving device is subjected is produced via a spring. However, the force may be produced in other ways.

In a refinement of the invention, the receiving devices are composed of thermally stable (up to 260° Celsius) half-shells, into which the boosters and part of the adjoining detonating cord are fixedly inserted.

For cost savings, the half-shells are produced from plastic, preferably by injection moulding. The plastic is preferably one of the following:

High-temperature-resistant polyamide (PAGT)

Perfluoroalkyl vinyl ether (PFA)

Polyether ether ketone
Hexafluoropropylene (FEP)

A further feature of the invention is characterized in that the other receiving device subjected to a force is inserted in an end plate of the associated segment in an axially preloaded manner against the force of the spring via a bayonet catch. The preloading is therefore produced here by a spring which subjects the other receiving device to a force in the direction of the adjacent receiving device of the adjacent segment. However, the preloading may also be produced by another device. On connecting the segment to the connecting part, the other receiving device is automatically subjected to a force against the spring. It is also possible for both receiving devices to be subjected to a force against one another.

Advantageously, the half-shells of the receiving devices have clamping pins and recesses, these being arranged in a reversed or mirrored manner between the two half-shells. As a result, only matching half-shells can be assembled.

In a preferred refinement, there is arranged in the connecting part an indentation, advantageously a bore, into which a receiving device is pushed as far as a stop and the adjacent other receiving device of the adjoining segment projects into this indentation, the front sides of the boosters belonging to the two receiving devices being situated in the indentation. The front region of the boosters is thereby protected from contamination.

Preferably, the front sides of the receiving devices are of mushroom-shaped design in cross-section, so that on assembly dirt is displaced or is not deposited on the front faces.

For sealing and also holding, the other receiving device pushed into the indentation as far as a stop has on its circumferential surface an O-ring which lies against the wall of the indentation.

In a particular refinement, there are arranged on the receiving devices electrical contacts which, after the receiving device has been subjected to a force, make contact and thus, in addition to the transmission of the detonation effect, an electrical connection of the contacts also takes place.

A control signal for electrical or electronic components is preferably transmitted via the contacts and the control signal is an ignition signal to a detonator.

Further features of the invention are shown in the figures described below.

FIGS. 5 to 8 show the introduction of the receiving device into the connecting part in a device according to the present invention.

FIG. 10 shows a detail of a perforation system comprising individual segments 19, 20 lined up in a row one behind the other or coupled to one another.

Figure 1:
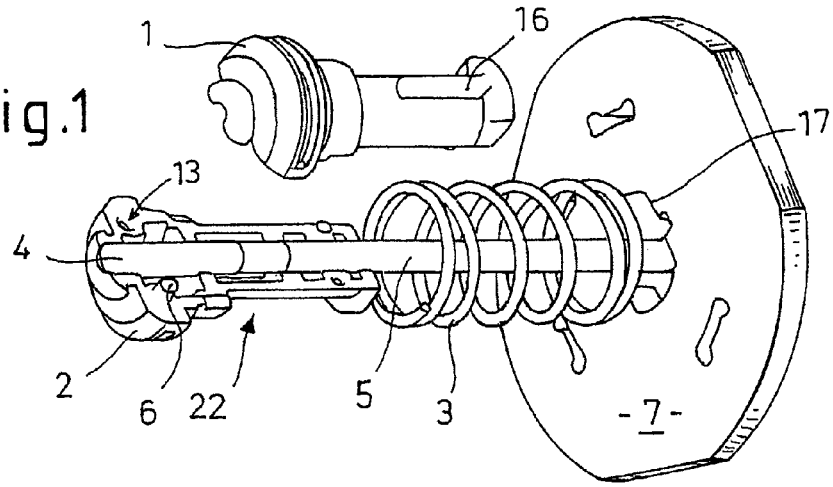
FIG. 1 shows an enlarged detail, exploded view of a portion of a device for transmitting the detonation effect from one detonating cord to another.

Such perforation systems are used, inter alia, for penetrating boreholes.

In the exemplary embodiment shown here, each of these segments 19, 20 comprises a carrier tube 9 and a charge carrier tube 8 arranged in the carrier tube 9. Perforators 14 are attached to this charge carrier tube 8. In this case, these are shaped-charge perforators which on ignition pierce the carrier tube 9 and break open or penetrate the borehole wall (not shown here).

The individual segments 19, 20 are rigidly connected to one another via a connecting part 11. For this purpose, the connecting part 11 has on its two ends in each case one thread on its outer circumference, by which threads the connecting part 11 is screwed into the segments 19, 20 or into the carrier tube 9 thereof.

To ignite the perforators 14, a detonating cord 5 is led through the individual segments 19, 20, the cord touching the perforators 14 at their rear side and on ignition causing them to ignite.

The invention described here improves the transfer of the ignition from one segment 19 to the other segment 20.

This is described more precisely below with reference to FIGS. 1 to 8 and as an overview with reference to FIG. 9. The same reference symbols in the figures also denote the same object.

Figure 9:
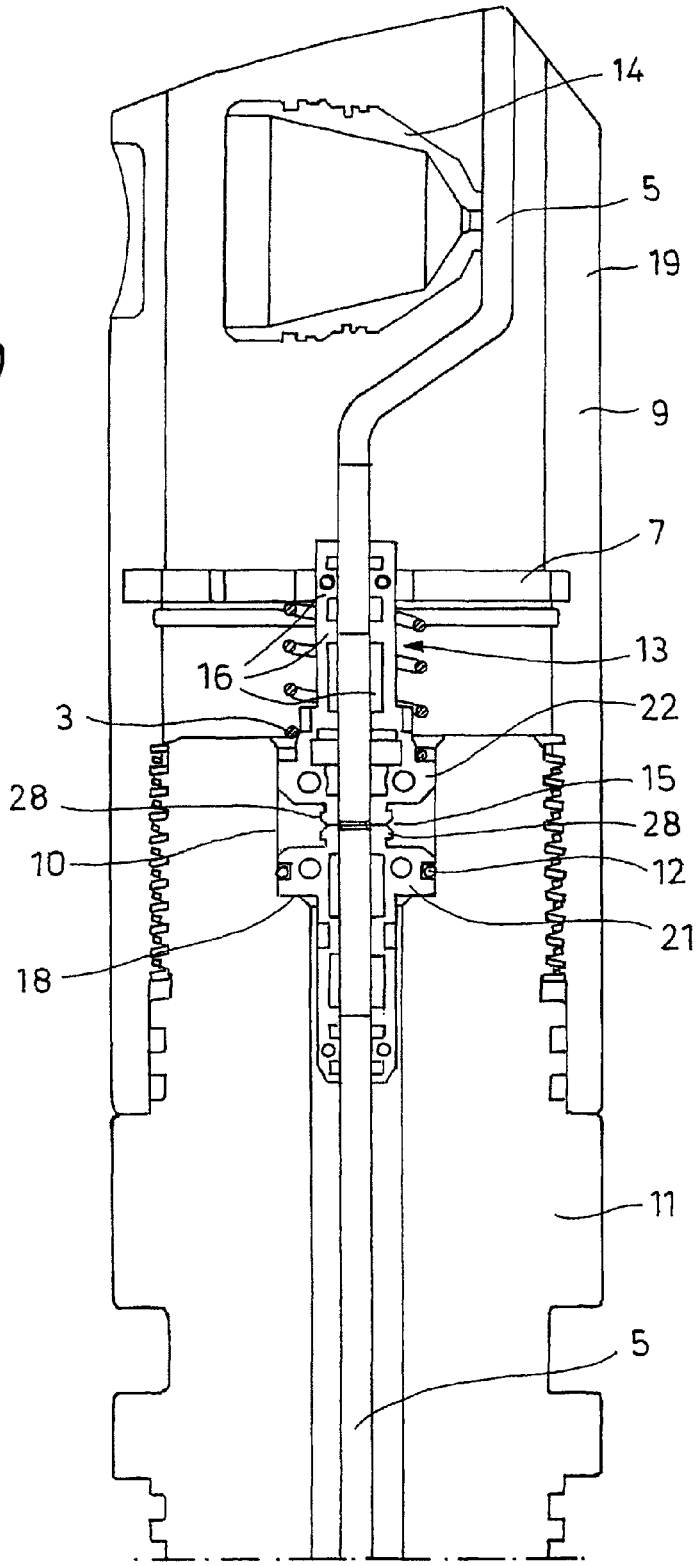
FIG. 9 shows an overview of fastening the connecting part to the segment of a device according to the present invention.
Figure 10:
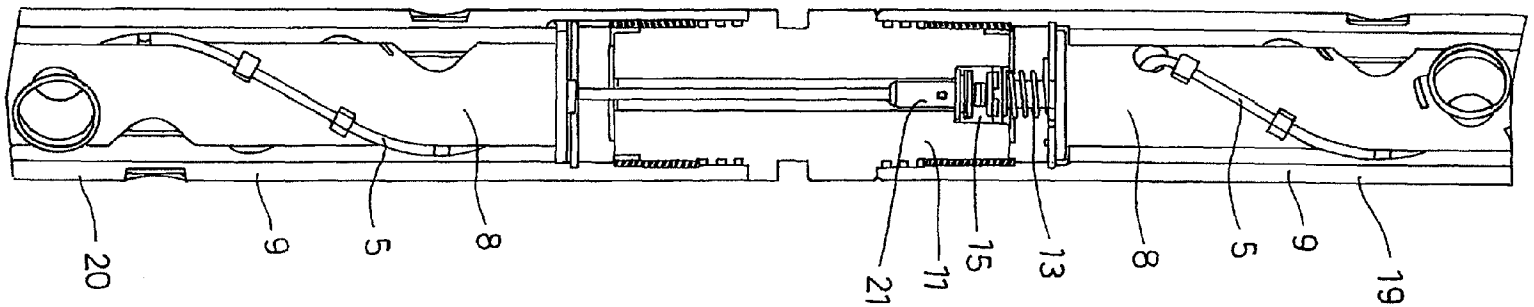
FIG. 10 shows a detail of a perforation system.

FIGS. 1 to 4 show an enlarged detail from FIGS. 9 and 10 in a different representation.

The transfer of the ignition is effected via a booster kit DW (transfer system) which, in the embodiment described here, comprises, inter alia, two half-shells 1, 2 made of injection moulded plastic which form the associated receiving device 22.

A booster 4 is crimped on the detonating cord 5 and placed in one of the two half-shells 1, 2, the front face of the booster 4 terminating virtually flush with the front face of the receiving device 22 (see FIG. 9) or of the two half-shells 1, 2.

The front side of the receiving devices 21, 22 is of mushroom-shaped 28 design, so that on assembly dirt is displaced or is not deposited on the front faces.

To enable the two half-shells 1, 2 to be fitted together, they have clamping pins 6 and recesses 13, the positions of which are reversed between the two half-shells 1, 2, the clamping pins 6 of one half-shell fitting into the recesses 13 of the other half-shell and vice versa. Before the two half-shells 1, 2 are fitted together, a spring 3 in the form of a helical spring is slipped onto the detonating cord 5. The two half-shells 23, 24 can also be screwed to one another.

To enable the two half-shells 23, 24 to be disassembled, a preferably wedge-shaped opening 29 is provided at the connecting edge. The two half-shells 23, 24 can then be easily separated from one another using standard tools, such as, for example, a screwdriver.

Apertures 17 are made in an end plate 7 of the segment 19, these apertures enabling that end of the receiving device 22 which is opposite the front face to be pushed in against the force of the spring 3 in a manner so positioned that it is arrested by a subsequent 90-degree rotation and a bayonet catch is formed.

Figure 2:
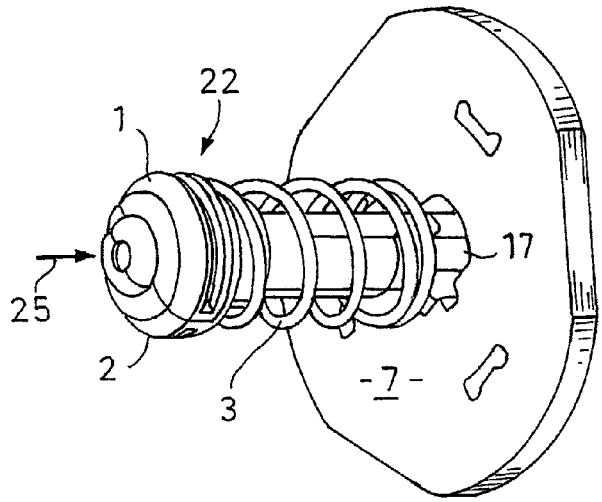
FIG. 2 shows the pushing-in operation of a device according to the present invention.

FIG. 2 shows the pushing-in operation. The arrow 25 denotes the pushing-in direction.

Figure 3:
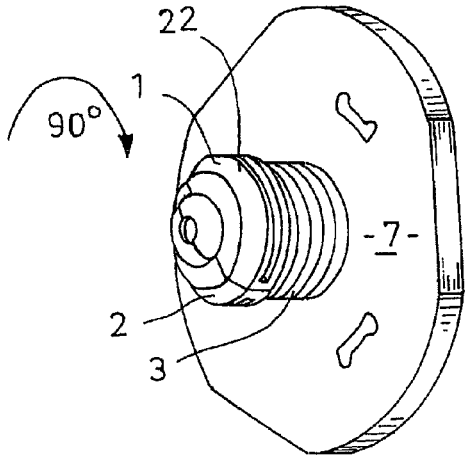
FIG. 3 shows a device according to the present invention with the receiving device is pushed in to the maximum.

In FIG. 3, the receiving device 22 is pushed in to the maximum. The spring 3 is compressed. Now, the receiving device 22 is rotated through 90 degrees and released again.

Figure 4:
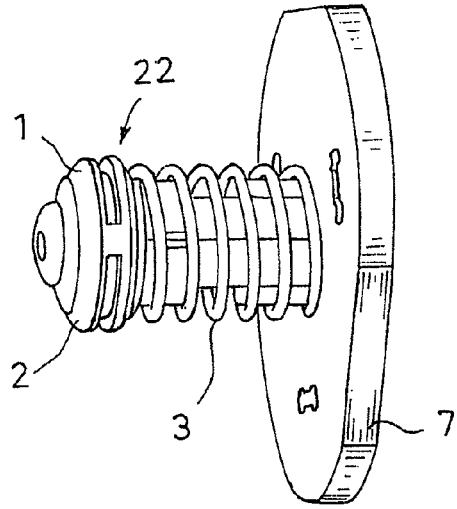
FIG. 4 shows a device according to the present invention with the receiving device arranged preloaded in the end plate.
Figure 5:
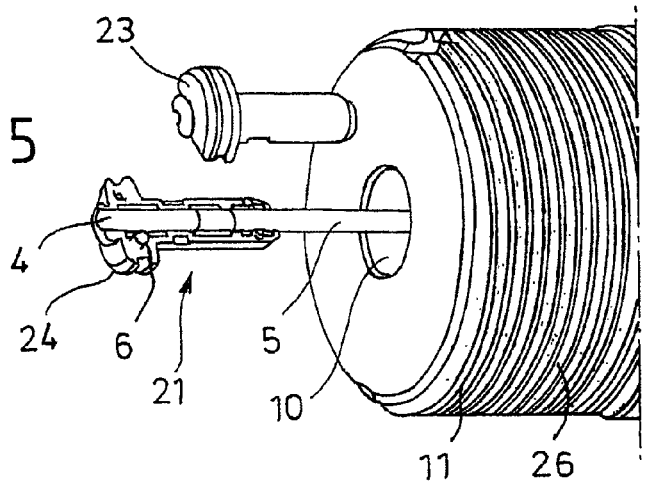
Figure 6:
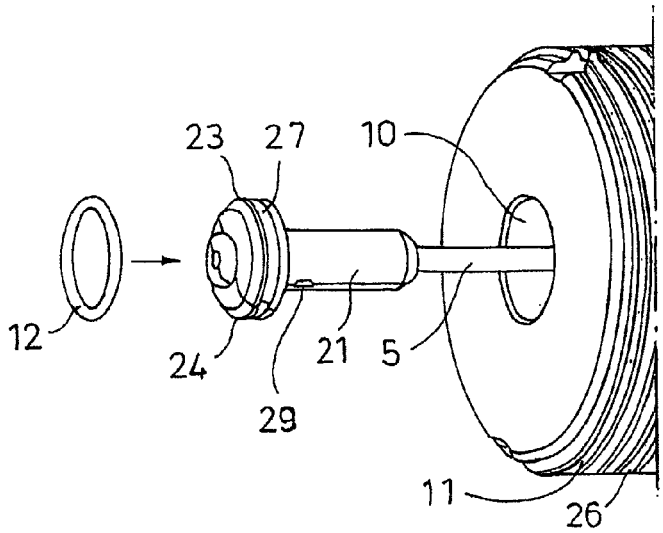

As a result, the receiving device 22 is arranged preloaded in the end plate 7 (see FIG. 4).

FIGS. 5 to 8 show the introduction of the receiving device 21 into the connecting part 11. The detonating cord 5 is led through the segment 20 from one perforator 14 to the other and also passes through the connecting part 11. The thread 26 by which the connecting part 11 is screwed into the segment 20 can be clearly seen.

Again, a booster 4 is crimped or fastened on the detonating cord 5 and placed in one of the two half-shells 23, 24 and fixed by pressing together the half-shells. Here, too, the front side 15 of the booster 4 is arranged flush with the front side of the two half-shells 23, 24 or of the receiving device 21 (see also FIGS. 9 and 10).

After the receiving device 21 has been assembled, an O-ring 12 (see FIG. 6) is mounted onto the outer circumference of the receiving device 21 into a circumferential groove 27 provided therefore.

Next, the receiving device 21 is inserted into an indentation 10 in such a way that the receiving device 21 rests on a stop 18 (or else a shoulder). Even when pressure is applied to the receiving device 21, the latter cannot be pushed in further than to this stop 18 (see FIGS. 7 and 8 and FIGS. 9 and 10).

On fastening the connecting part 11 to the segment 19 (see FIG. 9), the receiving device 22 projects into the indentation 10 in the connecting part 11 until the two receiving devices 21, 22 and hence the boosters 4 are in contact at their front sides.

Next, on screwing the connecting part 11 further into the segment 19, the receiving device 21 exerts a pressure on the receiving device 22 and pushes the latter against the force of the spring 3 in the direction of the end plate 7. As a result, both receiving devices 21, 22 are pressed with pressure against one another and hence also the front faces of the boosters 4.

The described booster kit DW according to the invention thus comprises four thermally stable (preferably up to 260° C.) and, for example, injection-moulded half-shells 1, 2 made of plastic, and a standard metal spring 3.

A further description of the features according to the invention follows.

After crimping on, the booster 4 and the detonating cord 5 are placed in the half-shells and fixed between them by means of clamping pins 6.

The additional part of the booster kit DW is the profile 17 in the lower part of the end plate 7 of the charge carrier tube 8, which enables simple fitting of the two clamped-together half-shells 1, 2 by positioned pushing-in and subsequent 90°-degree rotation.

The spring 3 ensures, inter alia, fixing of the two half-shells 1, 2 to the end plate 7. At the upper end of the outer carrier tube 9, half-shells 23, 24 of the same kind with installed booster 4 and detonating cord 5 are fixed by means of an O-ring 12 by way of a bore or indentation 10 in the connecting part 11.

Besides fixing the booster kit in the end plate 7, the spring 3 additionally ensures flexibility. Given the different diameters and the different distances between the individual booster kits situated in the respective carrier tubes 9 of the connecting parts 11, a dynamic stress is built up, thereby avoiding the accumulation of foreign bodies between the boosters.

The assembled parts can be taken apart again without problems using a simple tool, if this is necessary. The explosive components can thus be recovered undamaged, in the event of excessive ageing (after 5 years) or following discontinuation of the use of the carrier tubes.

Further Advantages of the Invention

The explosive components (detonating cord 5, booster 4) in the booster kit/transfer kit are held or clamped in the end plate 7 by means of preformed profiles 16 on the receiving device 22.

The accumulation of foreign bodies between the assembled boosters 4 is avoided owing to the spring action and shaping of the parts.

The spring action enables universal use with different carrier tube and charge carrier tube diameters, since the spring 3 compensates for different distances.

The receiving device 22 is fixed by the profile 17 in the end plate 7 and by shaping of the parts.

The booster kit/transfer kit can be taken apart again by simple means and used repeatedly, if it is not used with explosives.

The invention is thus distinguished in that the respective ends of the detonating cord 5 at which the boosters 4 are situated are immovably inserted into two half-shells 1, 2, 23, 24 preferably made of plastic. These two half-shells 1, 2, 23, 24 with the end of the detonating cord 5 and of the booster 4 are then inserted into the connecting part 11 and into the end plate 7 of the adjoining carrier tube 9. It is essential here that one of these two parts, comprising two half-shells, is subjected to a force in the direction of the other adjoining part, so that no gap is present between the two front faces of the two boosters 4. This force is preferably produced by the spring.

The invention claimed is:

1. A method for transmitting the detonation effect from one detonating cord- to another, comprising:

providing the detonating cords- having a booster- at their respective ends in respective receiving devices, the booster of the one detonating cord together with the booster of the other detonating cord, to which the detonation effect is to be transmitted, being arranged with their front sides adjacent, providing an element for subjecting at least one booster of two adjacent detonating cords to a force in the direction of the other booster, so that the front sides-of the adjacent boosters are always in contact, and transmitting a detonation effect from one detonating cord to another through the front sides- of the adjacent boosters that are in contact.

2. The method according to claim 1, characterized in that the at least one of the receiving devices of two adjacent detonating cords is subjected to a force in the direction of the adjacent receiving device.

3. The method according to claim 1, characterized in that the element for subjecting at least one booster of two adjacent detonating cords to a force in the direction of the other booster is a spring.

4. A device comprising individual segments coupled to one another, each segment containing charges of explosive, and having detonating cords led through each segment and serving to ignite the charges, the detonating cords having boosters at their respective ends, and the first booster of the detonating cord of the first segment being coupled to the adjoining second booster of the detonating cord of the second segment in such way that the front sides of the adjacent first and second boosters lie opposed to one another in their axial direction and thus, on use, transmit the ignition process from the first segment to the second segment, the boosters each being fixed in a receiving device, and an element for subjecting at least one of the receiving devices to a force in the direction of the adjacent receiving device, so that the front sides of the adjacent boosters are always in contact on use of the device.

5. The device according to claim 4, characterized in that one of the receiving devices does not have an element for subjecting it to a force in the direction of the adjacent receiving device, and the receiving device not subjected to a force is fixed in the segment.

6. The device according to claim 4, characterized in that the segments are connected to one another via a connecting part on use and one of the adjacent receiving devices is fixed in the connecting part.

7. The device according to claim 4, characterized in that the device is a perforating gun for deep borehole blasting and the charges are perforators.

8. The device according to claim 4, characterized in that the element for subjecting at least one of the receiving devices to a force in the direction of the adjacent receiving device is a spring.

9. The device according to claim 4, characterized in that the receiving devices comprise half-shells thermally stable up to 260° Celsius, into which the boosters and part of the adjoining detonating cord are fixedly inserted.

10. The device according to claim 9, characterized in that the half-shells are produced from plastic.

11. The device according to claim 10, characterized in that the half-shells are produced from plastic by injection moulding.

12. The device according to claim 9, characterized in that the half-shells of the receiving devices have clamping pins and recesses and the clamping pins and recesses are arranged in a reversed manner between the two half-shells, with the result that only matching half-shells can be assembled to form a receiving device.

13. The device according to claim 4, characterized in that the receiving device subjected to a force is inserted in an end plate of the associated segment in an axially preloaded manner against the force of a spring via a bayonet catch.

14. The device according to, claim 4, characterized in that there is arranged in the connecting part an indentation, into which a receiving device is pushed as far as a stop and the adjacent receiving device of the adjoining segment projects into this indentation, the front sides of the two boosters being situated in the indentation.

15. The device according to claim 4, characterized in that the receiving device pushed into the indentation as far as a stop has on its circumferential surface an O-ring which lies against the wall of the indentation.

16. The device according to claim 4, characterized in that the front sides of the receiving devices are of mushroom-shaped design in cross-section.

17. The device according to claim 4, characterized in that there are arranged on the receiving devices electrical contacts which, after the receiving device has been subjected to a force, make contact and thus, in addition to the transmission of the detonation effect, an electrical connection of the contacts also takes place.

18. The device according to claim 17, characterized in that a control signal for electrical or electronic components is transmitted via the contacts.

19. The device according to claim 18, characterized in that the control signal is an ignition signal to a detonator.

* * * * *